US008978340B2

(12) United States Patent
Kim et al.

(10) Patent No.: US 8,978,340 B2
(45) Date of Patent: Mar. 17, 2015

(54) METHOD FOR FIRE-PROOFING COMPOSITE SLAB USING WIRE ROPE

(71) Applicant: Korea Institute of Construction Technology, Gyeonggi-Do (KR)

(72) Inventors: Heung-Youl Kim, Seoul (KR); In-Hwan Yeo, Seoul (KR); Hyung-Jun Kim, Gyeonggi-Do (KR); Kyung-Hoon Park, Gyeonggi-Do (KR); Oh-Sang Kweon, Gyeonggi-Do (KR)

(73) Assignee: Korea Institute of Construction Technology, Gyeonggi-Do (KR)

( * ) Notice: Subject to any disclaimer, the term of this patent is extended or adjusted under 35 U.S.C. 154(b) by 0 days.

(21) Appl. No.: 14/080,797

(22) Filed: Nov. 15, 2013

(65) Prior Publication Data

US 2014/0144101 A1 May 29, 2014

(30) Foreign Application Priority Data

Nov. 23, 2012 (KR) ..... 10-2012-0133611

(51) Int. Cl.
*E04B 1/92* (2006.01)
*E04B 5/00* (2006.01)
*E04B 1/94* (2006.01)

(52) U.S. Cl.
CPC .. *E04B 5/00* (2013.01); *E04B 1/941* (2013.01)
USPC ..... 52/741.3

(58) Field of Classification Search
CPC .. E04B 1/941–1/945; E04B 5/00; E04B 5/16; E04B 5/23; E04B 5/29; E04B 5/43; E04G 23/0229; E04G 23/0237; E04G 23/024
USPC ..... 52/741.3, 745.05, 339, 338, 334, 335, 52/340, 333, 319
See application file for complete search history.

(56) References Cited

U.S. PATENT DOCUMENTS

| | | | | | |
|---|---|---|---|---|---|
| 533,201 | A | * | 1/1895 | Pierson | 52/126.5 |
| 540,451 | A | * | 6/1895 | MacKnight | 52/333 |
| 690,621 | A | * | 1/1902 | Schratwieser | 52/339 |
| 742,811 | A | * | 10/1903 | Wilmoth et al. | 52/326 |
| 794,438 | A | * | 7/1905 | Weber | 52/333 |
| 809,090 | A | * | 1/1906 | Caine | 52/326 |
| 1,171,400 | A | * | 2/1916 | Hoge | 52/231 |
| 1,174,452 | A | * | 3/1916 | Stewart | 52/326 |
| 1,190,206 | A | * | 7/1916 | Storm | 52/321 |
| 1,235,636 | A | * | 8/1917 | Bagnall et al. | 52/326 |
| 1,464,711 | A | * | 8/1923 | Hoge | 52/338 |
| 1,796,851 | A | * | 3/1931 | Macomber | 264/31 |
| 1,973,742 | A | * | 9/1934 | Bauer | 52/338 |
| 2,844,024 | A | * | 7/1958 | McDonald | 52/326 |

(Continued)

OTHER PUBLICATIONS

Kim et al., "An Experimental Study on Fire Resistance Performance and Evaluation of Asymmetric Slim Floor Beam", Advanced Materials Research, Jan. 2012, p. 1103~1108, vol. 446-449.

*Primary Examiner* — Christine T Cajilig
(74) *Attorney, Agent, or Firm* — Jianq Chyun IP Office

(57) ABSTRACT

Provided is a method for fire-proofing a composite slab constructed of beams installed between columns, a deck plate installed between the beams and slab concrete poured on the beams and the deck plate using a wire rope. Fire-proofing performance of the composite slab manufactured according to the present invention can be enhanced by transferring the load transferred from the deck plate to the upper portion of the beam via the wire rope.

9 Claims, 16 Drawing Sheets

(56) References Cited

U.S. PATENT DOCUMENTS 3,113,402 A * 12/1963 Butler ..... 52/745.05
3,619,959 A * 11/1971 Parker ..... 52/223.6
4,151,694 A * 5/1979 Sriberg et al. ..... 52/665
4,592,184 A * 6/1986 Person et al. ..... 52/334
4,700,519 A * 10/1987 Person et al. ..... 52/334
7,013,613 B1 * 3/2006 Boellner et al. ..... 52/837
7,624,550 B2 * 12/2009 Ospina ..... 52/334

* cited by examiner

METHOD FOR FIRE-PROOFING COMPOSITE SLAB USING WIRE ROPE

CROSS-REFERENCE TO RELATED APPLICATION

This application claims priority to and the benefit of Korean Patent Application No. 10-2012-0133611, filed on Nov. 23, 2012, the disclosure of which is incorporated herein by reference in its entirety.

BACKGROUND

1. Field of the Invention

The present invention relates to a method for fire-proofing a composite slab using a wire rope, and more particularly, to a method for fire-proofing a composite slab constructed of beams installed between columns, a deck plate installed between the beams and slab concrete poured on the beams and the deck plate, which allows a load transferred from the deck plate to be transferred to an upper portion of the beam via the wire rope to enhance a fire-proofing performance of the composite slab.

2. Discussion of Related Art

In general, a deck plate in the field of construction materials refers to a slab material manufactured by machining a metal plate such as galvanized sheet iron, and this deck plate is employed instead of a form and is not dismantled after pouring concrete to form a structure when a slab (also called a "floor slab") of a building structure is constructed.

If the deck plate is employed to construct the slab, there is no need to utilize a form (formboard) for the slab concrete, and time and cost required for performing preparatory work such as construction of a form can be saved. Also, since the slab construction is performed by continuously placing and fixing the deck plates having a unit length on the beam, the construction can be easily carried out. In addition, the deck plates mass-produced in a factory are utilized so that is it possible to secure a quality higher than a certain level.

Recently, using the above deck plate for constructing the slab is a growing trend in the field of construction.

FIG. 1*a* shows an example method for manufacturing such deck plate.

In other words, thin plate-shaped materials for a slab formed into various bending panels as shown in FIG. 1 are mainly utilized in a long-span deck plate.

FIG. 1*b* shows an example of a double deck formed in the form of the above bending panel and installed on a beam.

In other words, from FIG. 1*b*, it can be seen that a deck plate 20 is installed such that an end portion of the deck plate 20 is supported by a lower flange 12 of a beam 10.

At this time, it can be seen that one end portion of each of the plurality of deck plates is supported by the beam 10. Thus, a reinforcing steel beam having a larger width is utilized to manufacture the lower flange 12 of the beam so as to easily support an end portion of the deck plate.

As shown in FIG. 1*c*, due to the above, since a section of the beam 10 is designed such that a weight of the beam, a weight of the deck plate and a weight of a slab concrete 50 in which a reinforcing bar 52 is arranged can be supported, a section of the beam can be variously obtained.

Furthermore, if fire breaks out in a building constructed with the slab concrete 50, the concrete can be explosively fractured by flames, and if the concrete is explosively fractured, structural members surrounding the concrete, for example, the beam 10, are influenced by the flames.

Thus, once a stiffness of the beam 10 supporting a weight of the deck plate and the slab concrete 50 in which the reinforcing bar 52 is arranged is lowered by the flames, the building will indubitably collapse.

In order to prevent a stiffness of the beam formed of steel material from being lowered by the flames, a construction method for covering the beam and the deck plate with a spray coating material (indicated by the grey part) for thermal insulation has been introduced as shown in FIG. 1*d*.

In the fire-proofing method utilizing the above spray coating material for thermal insulation, however, a problem of securing a quality in a thickness of the spray coating layer can occur, and thus strict quality control is required (lowering of workability and constructibility). As a result, a construction period is increased and this causes an increase of construction cost.

FIG. 1*e* shows a construction method for preventing a lowering of stiffness of the slab caused by an increase of temperature without utilizing the spray coating material. In this method, a fire-proofing board (indicated by the violet part) is attached to a region including a central portion of the deck plate in the composite slab for thermal insulation in the event of fire.

However, if an adhesion property of the fire-proofing board deteriorates, a stiffness of the beam and the like which are directly exposed to the flames may be rapidly lowered. Also, an installation of the fire-proofing board causes an additional process and an increase of construction cost, and the construction cost and the construction period are increased due to expensive materials (the fire-proofing board, a frame for installing the fire-proofing board and the like).

FIG. 1*f* shows a deflection controlling method for preventing deflection of a central portion of the beam 10, which is one of conventional fire-proofing methods.

In the conventional composite slab, in other words, since deflection of the central portion of the beam is increased in the event of fire in proportion to a distance between the beams which are exclusively responsible for the load, casualties are caused by a collapse of the slab.

Accordingly, to control deflection of the central portion of the beam, a technique of controlling deflection of a central portion through tendons (shown as three rods) utilized for introducing pre-stress to a web of the beam has been applied.

In other words, in order to complement a reduction of stiffness caused by the flames, the above method does not include forming the spray coating layer or attaching a fire-proofing board to the beam 10, but rather introducing the pre-stress to the beam.

For the beam having a relatively high stiffness, it is possible to control deflection of the central portion through the tendons (pre-stressing strands, steel bars and the like). However, there is a limit to which the above pre-stressing method can be applied to the deck plate.

This is because, since the deck plate is a thin plate-shaped material for the slab and is frequently manufactured from a bending panel, if a strong pre-stress of the tendon is introduced to the deck plate, it is not easy to anticipate the structural performance due to a shape change of the deck plate.

Also, if the tendon is directly installed on the deck plate, workability and constructibility necessarily become less efficient. This is because since a steel bar (pre-stressing strand) is utilized as the tendon employed for securing the fire-proofing performance, the efficiency in machining and installation of the above material is extremely low.

SUMMARY OF THE INVENTION

Accordingly, an object of the present invention is to provide a method for fire-proofing a bare long-span composite slab using an economical wire rope, the composite slab being constructed of a beam supportably installed on a column, a deck plate installed on the beam and slab concrete poured on the deck plate, the method being capable of:

Firstly, effectively controlling deflection of the composite slab to enhance fire-proofing performance of the composite slab;

Secondly, increasing an efficiency of the load transfer without covering the beam with a spray coating material to sufficiently secure fire-proofing performance; and Thirdly, effectively distributing the load transferred from the deck plate and transferring the distributed load to the beam and enhancing workability of installation of the transferring means and constructibility to utilize great advantages in terms of the structure and efficiency.

To achieve the object, the method for fire-proofing a composite slab according to an aspect of the present invention has the characteristic as below.

Firstly, except a slab concrete which is explosively fractured, the member of a long-span composite slab, whose stiffness is lowered by the flames in the event of fire, may be a beam and a deck plate. Thus, the present invention employs a light wire rope having excellent workability to control deflection of a central portion of the deck plate.

The wire rope may be connected to an upper surface of the deck plate (a mid portion at which a large deflection is generated) and an upper surface (upper flange) of the beam to control deflection of the deck plate whose stiffness is lowered in the event of fire.

At this time, the wire rope is manufactured by twisting thin element wires, and has a very small diameter (approximately 5 mm) and a light weight so that the wire rope has a merit of being easily conveyed and installed by a worker. In addition, the above wire rope has tensile stress which is remarkably larger than that of a conventional pre-stressing (PC) steel wire or anchor bolt so that this wire rope helps greatly in terms of the load transfer.

Secondly, in the conventional structure in which a wire rope is not provided, the entire load transferred from the deck plate to the beam due to deflection of the deck plate is concentrated and transferred to the lower flange of the beam. In the present invention, however, the load transferred from the deck plate can be distributed and transferred to a lower flange and an upper flange of the beam by the wire rope installed on an upper surface of the beam to secure structural efficiency.

For example, the wire rope extends from an upper surface of the deck plate to upper flanges of the beams placed at both sides of the deck plate, however, the wire rope is tensioned and anchored to the upper flange of the beam. As a result, the load transferred from the deck plate is distributed and transferred to the beam by the wire rope.

Thus, since the fire-proofing performance of the deck plate as well as the slab is remarkably enhanced by the wire rope, the fire-proofing performance of the beam supporting the slab is also significantly increased so that there is no need to apply the spray coating material and to install a fire-proofing board.

Thirdly, the present invention employs the wire rope, this wire rope functions as a tendon such as pre-stressing strands and light weight and can be easily processed. Thus, since an installation of the wire rope is easily performed, the workability and constructibility of the wire rope are excellent. As a result, although a process for installing the wire rope is added, a construction schedule delay and lowering of economical efficiency do not occur.

In other words, the present invention employing the wire rope can utilize a tensioning and anchoring device such as a connecting bolt and nut for enabling a pre-stress introduction process to be more easily performed so that excellent workability and constructibility can be obtained to sufficiently secure fire-proofing performance of the long-span composite slab having sufficient economical efficiency.

Fifthly, the pre-stress is introduced by using the wire rope in a pre-tension method or a post-tension method, that is, before pouring the slab concrete or after pouring the slab concrete so that it is possible to secure the fire-proofing performance of the slab.

For the above purpose, the present invention provides the method for fire-proofing a composite slab using a wire rope comprising installing a deck plate between beams; anchoring a wire rope to allow the wire rope to be connected to a mid portion of the installed deck plate and both end portions of the wire rope to extend to the beam placed above the deck plate; and forming slab concrete 130 on the beam and the deck plates, wherein the load transferred from the deck plate is distributed and transferred to the beam via the wire rope to enhance fire-proofing performance.

Preferably, in the method for fire-proofing the composite slab using the wire rope according to the present invention, one end portion of the wire rope is fix-anchored to the beam and the other end portion of the wire rope is tension-anchored to the beam to allow pre-stress to be introduced to the slab concrete through a post-tension method or a pre-tension method.

Preferably, in the method for fire-proofing the composite slab using the wire rope according to the present invention, an end portion of the deck plate is supportably installed on a lower flange of the beam and each end portion of the wire rope is fix-anchored or tension-anchored to an upper surface of an upper flange of the beam to allow the load transferred from the deck plate to be distributed and transferred to the beam via the wire rope.

Preferably, in the method for fire-proofing the composite slab using the wire rope according to the present invention, the mid portion of the deck plate is a region corresponding to L/2 of the extension length L of the deck plate, the deck plate is a bending panel in which bending portions are formed between horizontal portions, a plurality of wire rope supports are spaced from each other and arranged between the bending portions at the mid portion of the deck plate in the form of a parabola curved downward in the longitudinal direction of the deck plate, and the wire rope is disposed such that an upper surface of the wire rope is in contact with a lower surface of the wire rope support deck, whereby the wire rope can be disposed in the form of a parabola.

Preferably, in the method for fire-proofing the composite slab using the wire rope according to the present invention, the mid portion of the deck plate is a region corresponding to L/2 of the extension length L of the deck plate, the deck plate is a bending panel in which a bending portion is formed between horizontal portions, wire rope fixtures spaced apart from each other and have heights which differ from each other are disposed on an upper surface of the horizontal portion at the mid portion of the deck plate in the shape of a parabola in the longitudinal direction of the deck plate, and the wire rope passes through the wire rope fixtures, whereby the wire rope can be disposed in the shape of a parabola.

Preferably, in the method for fire-proofing the composite slab using the wire rope according to the present invention, the mid portion of the deck plate is a region corresponding to L/2 of the extension length L of the deck plate, the deck plate is a bending panel in which a bending portion is formed between horizontal portions, wire rope fixtures spaced apart from each other are disposed on a side surface of the horizontal portion at the mid portion of the deck plate in the shape of a parabola curved downward in the longitudinal direction of the deck plate, and the wire rope passes through the wire rope fixtures, whereby the wire rope can be disposed in the shape of a parabola.

Preferably, in the method for fire-proofing the composite slab using the wire rope according to the present invention, the fix-anchoring of the wire rope is performed using a fixed anchor and comprises vertically installing a ring-shaped bolt having a circular ring part formed on an upper portion thereof on an upper surface of the upper flange of the beam; and passing one end portion of the wire rope in the horizontal direction through the circular ring part of the ring-shaped bolt, bending one end portion of the wire rope, and compressing the circular ring part together with the overlapped wire rope by a compressing tool, wherein one end portion of the wire rope is fix-anchored to the upper flange of the beam by the fixed anchor.

Preferably, in the method for fire-proofing the composite slab using the wire rope according to the present invention, the fix-anchoring of the wire rope is performed using an anchoring block and a wedge, and comprises integrally fixing the anchoring block to an upper surface of the upper flange of the beam, the anchoring block having a through hole through which the wire rope can pass formed therein and an anchoring groove in which an anchoring cone can be inserted formed at a mid portion of the through hole; and inserting the wedge to allow the wire rope clamped to the wedge to be anchored to the anchoring groove, wherein one end portion of the wire rope is fix-anchored to the anchoring block formed on the upper flange of the beam.

Preferably, in the method for fire-proofing the composite slab using the wire rope according to the present invention, the tension-anchoring of the wire rope is performed using a tensioned anchor, and comprises installing two ring-shaped bolts on an upper surface of the beam, and inserting an anchoring bolt to be horizontally anchored into an outer ring-shaped bolt to allow a bolt portion of the anchoring bolt to be inserted into a circular ring part of the outer ring-shaped bolt; passing the other end portion of the wire rope which passes through an inner ring-shaped bolt installed at the upper flange of the beam and extends through the circular ring part of the anchoring bolt formed integrally with the bolt portion and bending it; and compressing the circular ring part together with the overlapped wire rope by a compressing tool to anchor the other end portion of the wire rope to an inner tensioned anchor, wherein the bolt portion can be anchored to the outer ring-shaped bolt by an anchoring nut.

Preferably, in the method for fire-proofing the composite slab using the wire rope according to the present invention, the tension-anchoring of the wire rope is performed using an anchoring block and a wedge, and comprises integrally fixing the anchoring block to an upper surface of the upper flange of the beam, the anchoring block having a through hole through which the wire rope can pass formed therein and an anchoring groove in which an anchoring cone can be inserted formed at a mid portion of the through hole; tensioning the wire rope; and inserting the wedge to allow the wire rope clamped to the wedge to be anchored to the anchoring groove, wherein the other end portion of the wire rope is fix-anchored to the anchoring block formed on the upper flange of the beam.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1A:
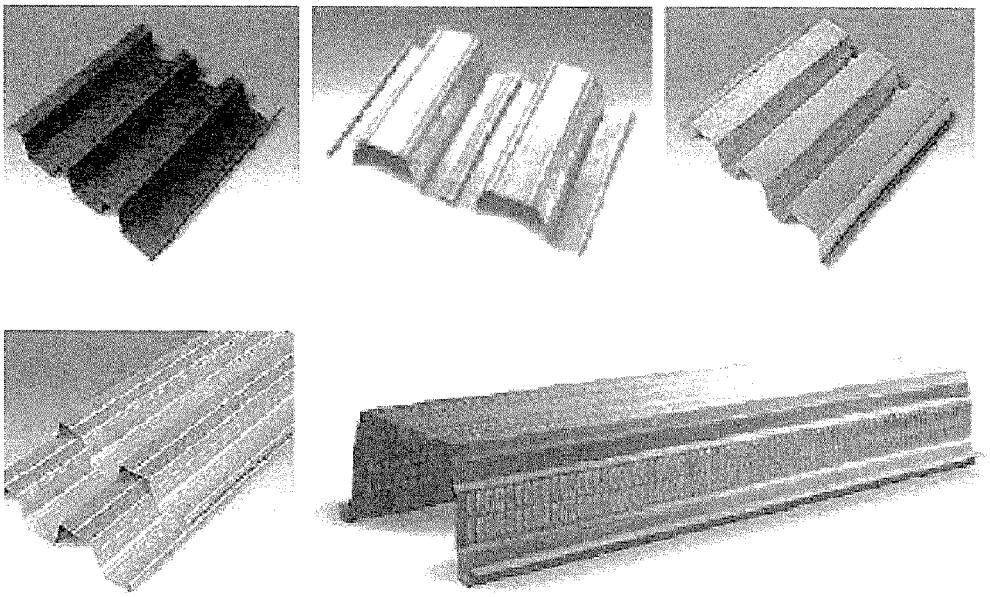
FIG.1a (Prior Art)
FIG. 1*a* is an exemplary view of a conventional deck plate for a building.
Figure 1B:
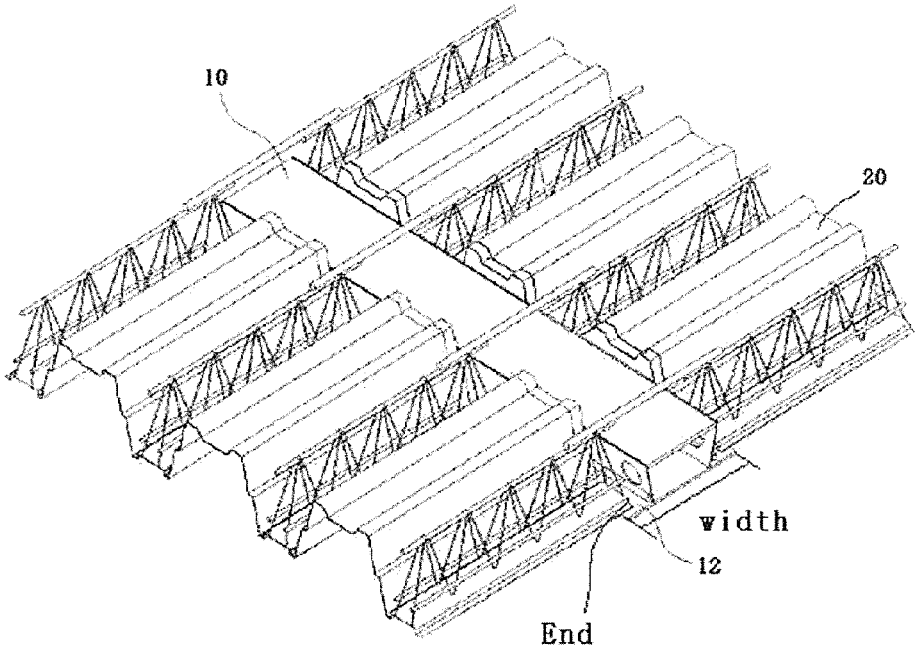
FIG.1b (Prior Art)
FIG. 1*b* is a perspective view showing a conventional deck plate and a beam coupled to each other.
Figure 1C:
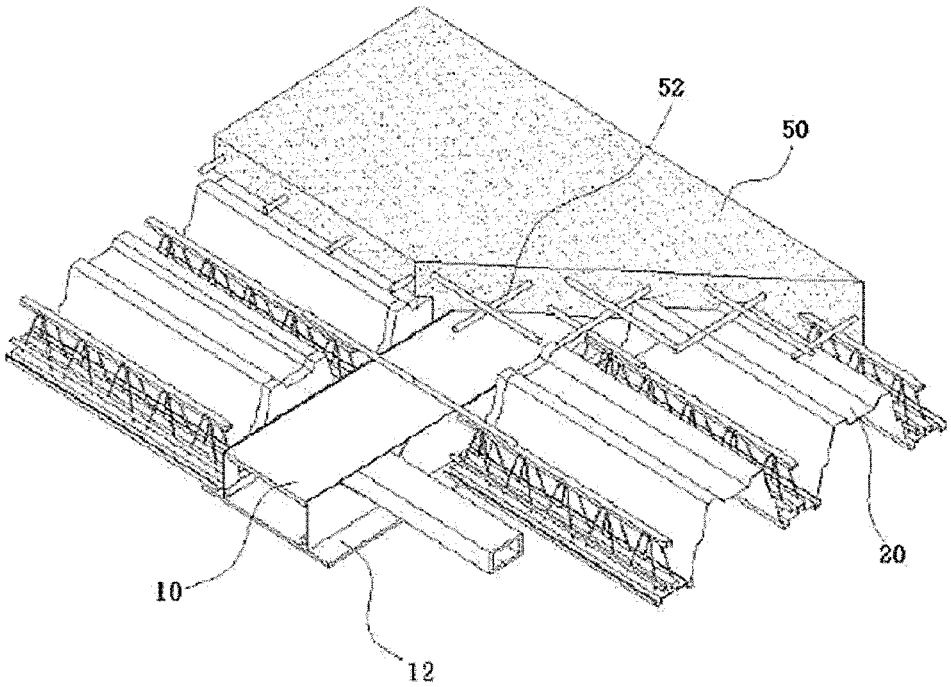
FIG.1c (Prior Art)
FIG. 1*c* is a partial view illustrating a constructing process of a composite slab utilizing a conventional deck plate, a beam and slab concrete.
Figure 1D:
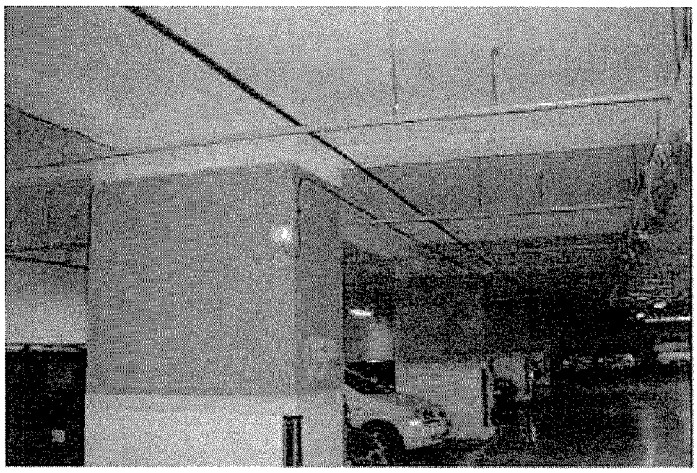
FIG.1d (Prior Art)
FIG. 1*d* and FIG. 1*e* are views showing examples of a method for fire-proofing a conventional composite slab.
Figure 1E:
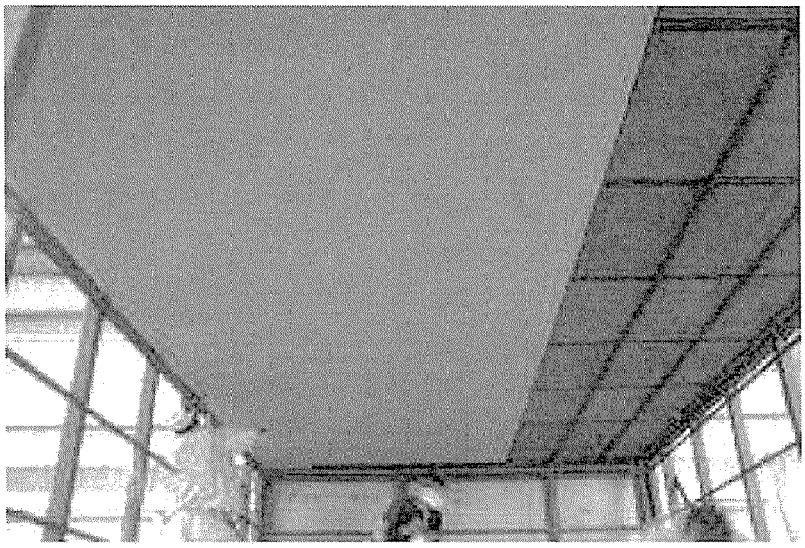
FIG.1e (Prior Art)
Figure 1F:
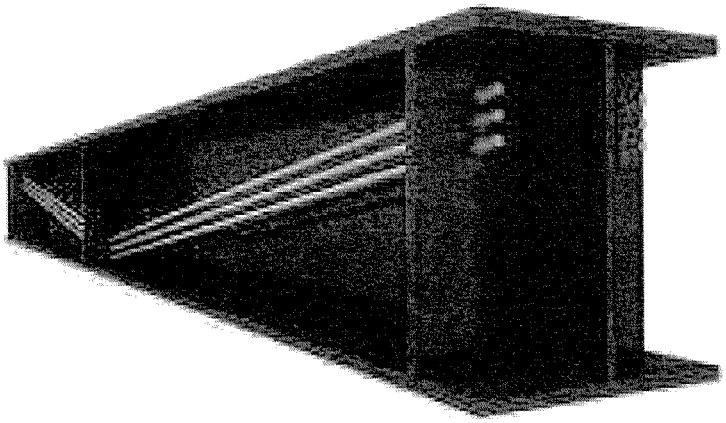
FIG.1f (Prior Art)
FIG. 1*f* is a conceptual view illustrating an installation of tendons for securing the strength of a conventional beam.

Exemplary embodiments of the present invention will be described in detail below with reference to the accompanying drawings. While the present invention is shown and described in connection with exemplary embodiments thereof, it will be apparent to those skilled in the art that various modifications can be made without departing from the spirit and scope of the invention.

The embodiment described in the specification and the structure illustrated in the drawings are only examples of the present invention and do not encompass all the technical spirit of the present invention. Accordingly, it should be understood that the various equivalents and modification can substitute the above examples.

[a Bare Long-Span Composite Slab 100 Employing a Wire Rope of the Present Invention]

Figure 2A:
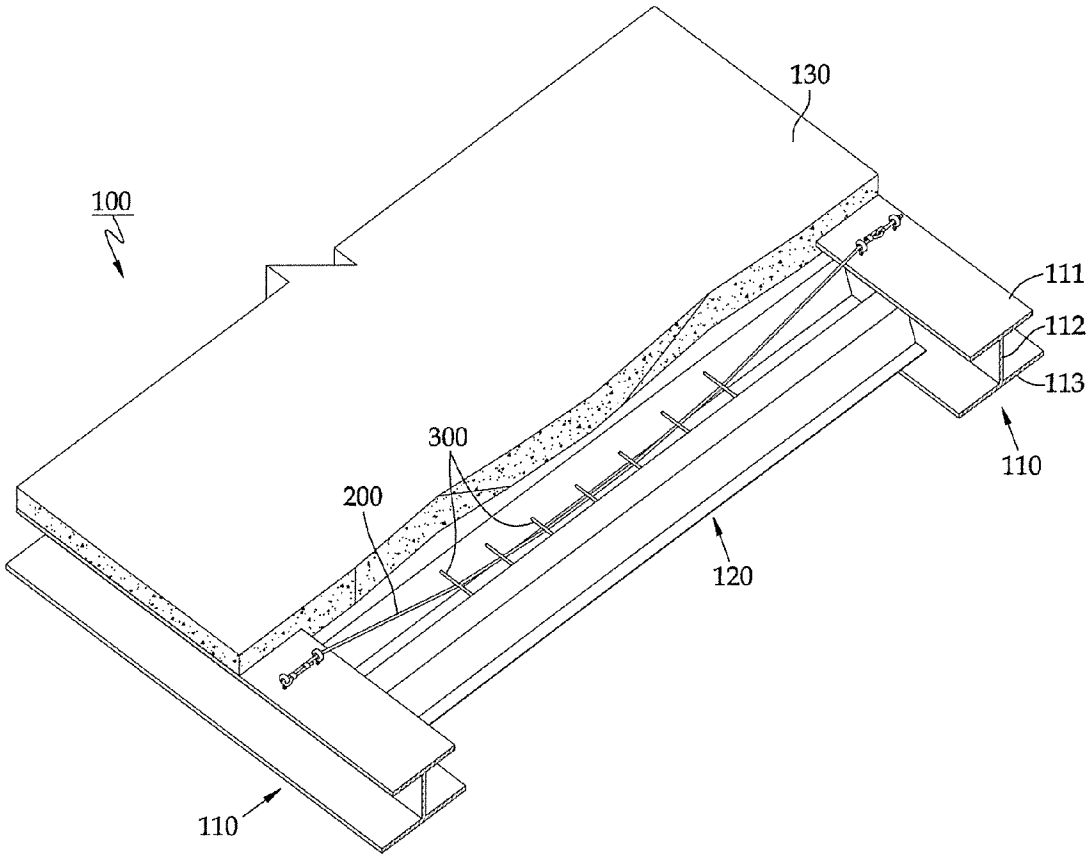
FIG. 2*a* and FIG. 2*b* are a perspective view and a cross-sectional view of a composite slab employing a wire rope of the present invention.
Figure 2B:
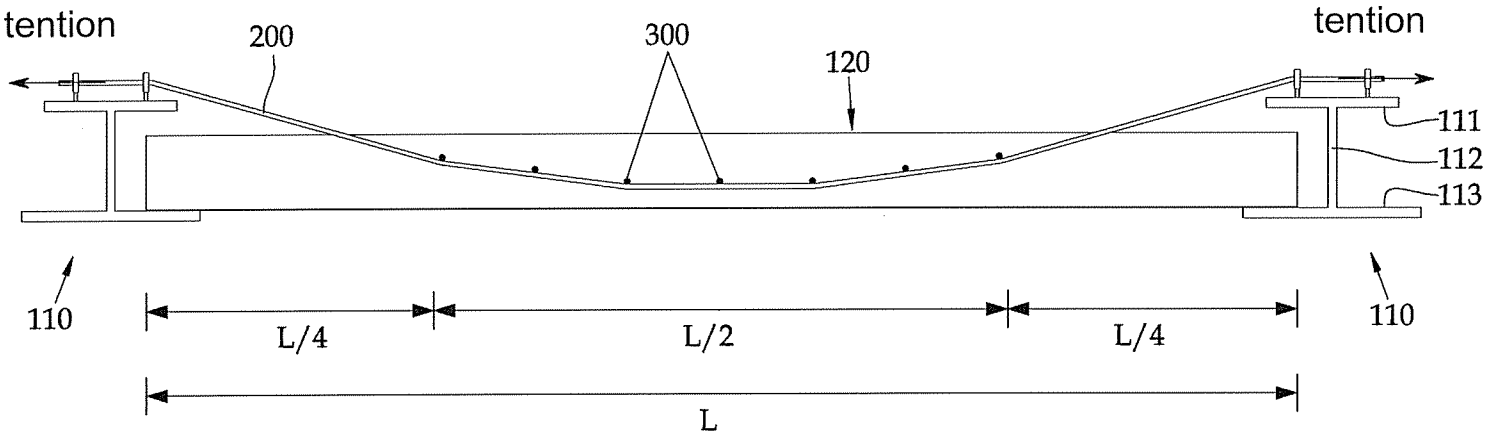

FIG. 2*a* and FIG. 2*b* are perspective view and cross-sectional view of the composite slab 100 employing a wire rope of the present invention.

The composite slab 100 includes a beam 110 placed on a column (not shown), a deck plate 120 installed between the beams and a slab concrete 130 formed on the beam and the deck plate.

Firstly, the beam 110 is formed of an H-shaped steel frame, and it can be seen that the beam consists an upper flange 111, a web plate 112 and a lower flange 113.

This beam 110 is installed such that the beam is placed between the columns, and both end portions of the beam are connected to the columns so that the columns and the beam function to support the composite slab.

At this time, the deck plate 120 is installed between the lower flanges 113 of the beams 110 as shown in FIG. 1.

In other words, it can be seen that the deck plate 120 employed in the conventional composite slab is formed into a bending panel to allow both end portions thereof to be supported between the lower flanges of the beams, that is, the deck plate 120 in which bending portions 122 are continuously disposed between horizontal portions 121 is installed.

At this time, the long-span composite slab may be regarded as a shape in which an extension length of the deck plate increases as a distance between the beams increases.

Further, the slab concrete 130 is poured onto an upper portion of the deck plate 120 and an upper portion of the beam 110, and a slab reinforcing bar 131 is arranged in the slab concrete.

From the above, it can be known that the weight of the deck plate 120 and the slab concrete 130 including the slab reinforcing bar 131 is transferred to the beam 110 through the lower flange 113 of the beam 110. Due to the load concentrated on the lower flange 113, the beam 110 is generally formed such that a width of the upper flange is larger than that of the lower flange.

At this time, in a case in which a fire breaks out after the composite slab 100 is constructed, if a fire continues until moisture in the slab concrete is expanded by flames and the slab concrete is explosively fractured, the slab concrete does not practically perform the function as the structural member bearing the load, but transfers only its own weight to the beam 110.

At this time, when the beam 110 is exposed to flames, its stiffness is lowered. In this state, if a weight burden is added to the beam by the slab concrete 130 which does not perform the load bearing function due to an explosive fracture, the load bearing capacity of the beam 110 deteriorates extremely so that this phenomenon may actually cause the building to collapse.

Therefore, the method for fire-proofing the composite slab 100 focuses on preventing the load bearing capacity of the deck plate 120 and the beam 110 from rapidly deteriorating when they are exposed to flames in the event of fire.

In the long-span composite slab, in particular, since an extension length of the deck plate 120 is lengthened, a quantity of the slab concrete 130 to be poured is increased so that the load transferred to the beam 110 is inevitably concentrated on the lower flange 113 of the beam 110.

The above concentrative load transfer may cause rapid deterioration of the load bearing capacity of the beam 110 so that the present invention does not transfer the load transferred from the deck plate 120 to the lower flange 113 of the beam 110, but distributes and transfers the load to the upper portion (the upper flange 111) of the beam.

For the above purpose, the present invention employs a wire rope 200.

The wire rope is manufactured by twisting thin element wires, and has a very small diameter (approximately 5 mm) and a light weight so that the wire rope has a merit of being easily conveyed and installed by a worker. In addition, the above wire rope has remarkably greater tensile stress than the conventional pre-stressing (PC) steel wire (tendon) or steel bar so that this wire rope helps greatly in terms of load transfer.

In the above wire rope 200, a layout arrangement is very important. As shown in FIG. 2, a mid portion between both side end portions of the wire rope 200 is secured to a mid portion of the deck plate 120. Here, the mid portion of the deck plate 120 may refer to a range of approximately the mid portion (L/2) with respect to entire length (L) of the deck plate, excluding both end portions (L/4).

This is because the largest bending moment is applied to a range of approximately the mid portion (L/2) of the deck plate 120 and the most significant deflection of the deck plate is generated on this mid portion.

In other words, the wire rope 200 is fixed to the portion at which the largest deflection is generated, and both end portions extend and are anchored to an upper surface of the upper flange 111 of the beam 110 rather than the lower flange.

Thus, it can be seen that the wire rope 200 is arranged in the form of a quadratic curve which is curved downward with respect to a lengthwise direction of the deck plate, and the shape of this wire rope is nearly similar to a deflection shape of the deck plate so that it is possible to dispose the wire rope so as to advantageously control deflection of the deck plate.

Ultimately, it can be seen that the mid portion of the deck plate is restricted and its deflection is controlled by the wire rope 200. Since such wire rope extends and is anchored to the upper flange of the beam 110 rather than the lower flange, the load is distributed so that it is possible to effectively control the deflection of the composite slab 100 and to contribute greatly to an enhancement of the fire-proofing performance.

[Method for Installing the Wire Rope 200 of the Present Invention]

The wire rope 200 as illustrated above can be installed on the deck plate 120 by means of a wire rope support 300, and the state in which this wire rope support 300 is installed on the deck plate is described with reference to FIG. 3*a*, FIG. 3*b* and FIG. 3*c*.

Figure 3A:
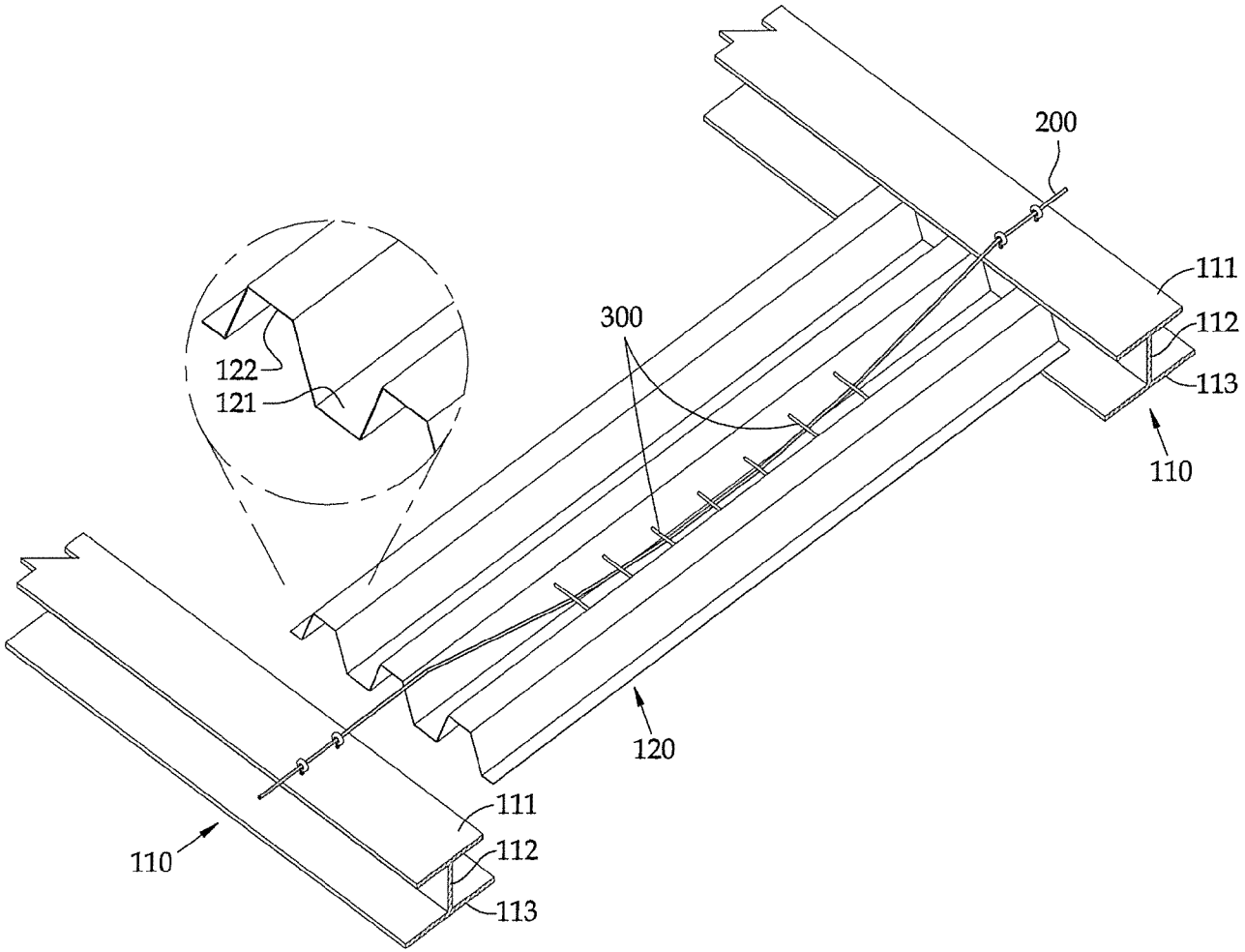
FIG. 3*a*, FIG. 3*b* and FIG. 3*c* are perspective views illustrating an installation of a wire rope of the present invention.

First of all, as shown in FIG. 3*a*, the horizontal portion 121 and the bending portion 122 are alternatively and continuously disposed to form the deck plate 120 and to place the bending portion between the horizontal portions. It can be seen that, between the bending portions 122, the wire rope supports 300 (a steel reinforcing bar is employed as the wire rope support) extending in the direction perpendicular to the longitudinal direction of the bending portion 122 are installed and spaced apart from each other.

At this time, the wire rope supports 300 are also disposed in the form of a quadratic curve between the bending portions to dispose the wire rope 200 in the form of a quadratic curve which is curved downward.

Thus, the worker can arrange the wire rope 200 below the wire rope support 300 to simply arrange the wire rope 200 in the shape of a parabola.

At this time, the wire rope 200 is disposed such that both end portions thereof extend from the upper surface of the upper flange 111 of the beam 110.

Figure 3B:
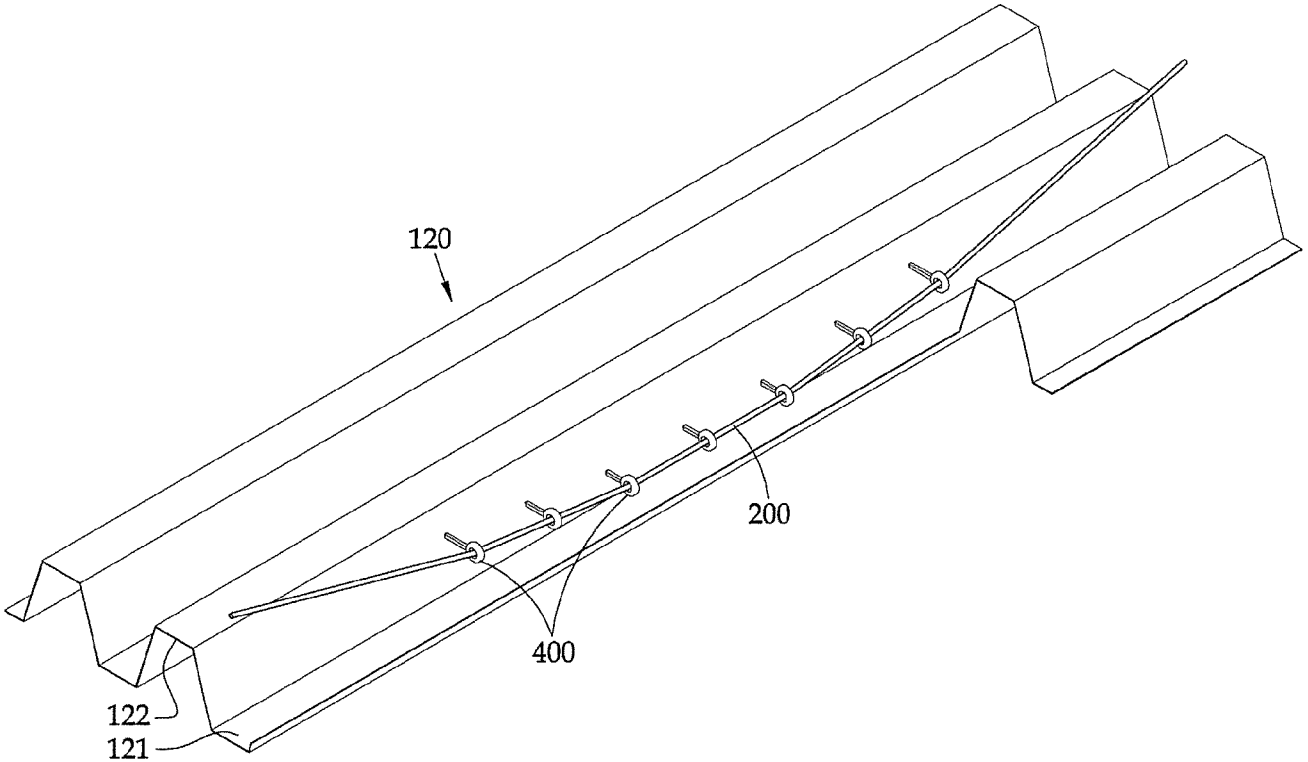
Figure 3C:
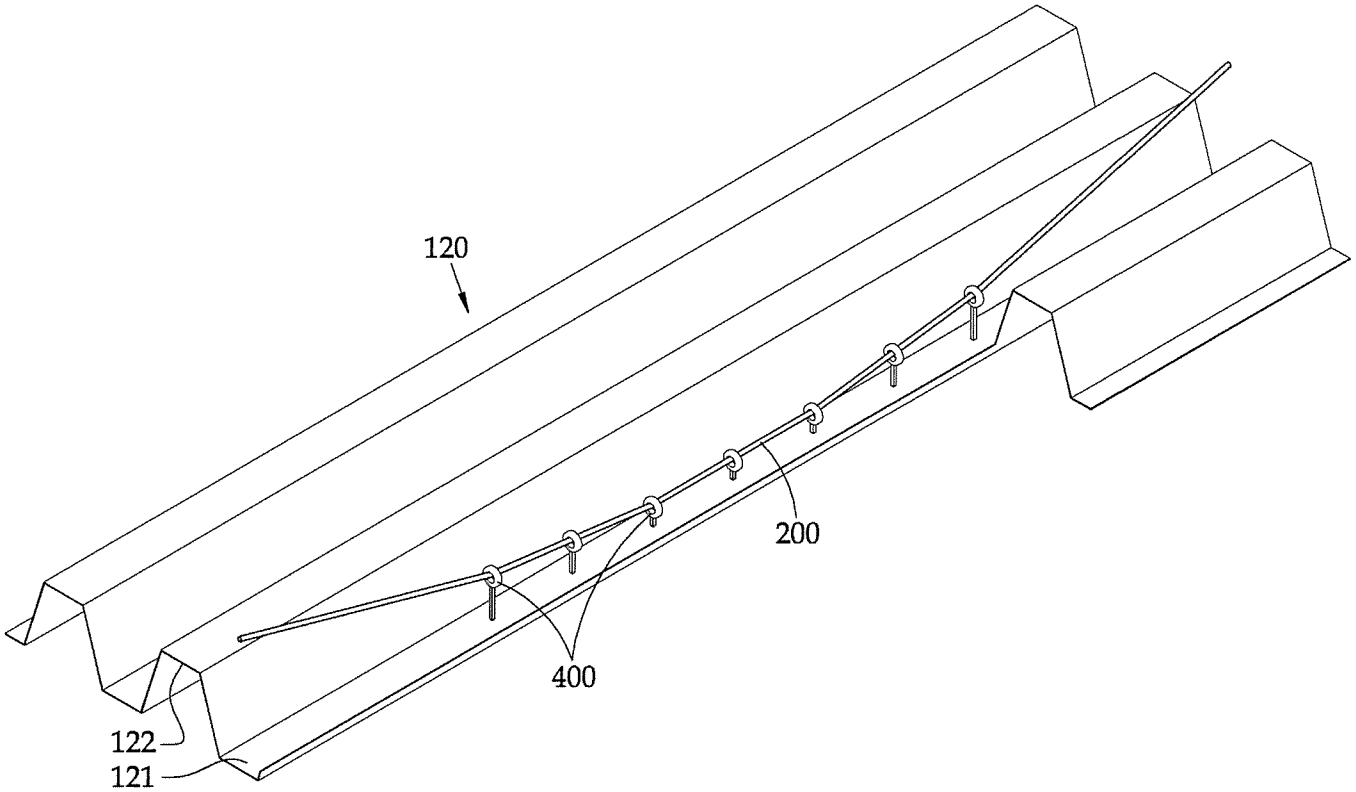

Next, as shown in FIG. 3*b* and FIG. 3*c*, the horizontal portion 121 and the bending portion 122 are alternatively and continuously disposed in the direction perpendicular to the longitudinal direction to form the deck plate 120. A wire rope fixture 400 including a ring is installed on an outer surface of the bending portion 122 or the horizontal portion 121, and the wire rope 200 passes through the wire rope fixture 400 to be arranged in the form of a quadratic curve which is curved downward.

Thus, the worker can anchor the wire rope 200 to the wire rope fixture 400 to simply arrange the wire rope 200 in the shape of a parabola.

At this time, the wire rope 200 is also disposed such that both end portions thereof extend from the upper surface of the upper flange 111 of the beam 110 placed at one side.

Ultimately, it can be seen that if both end portions of the wire rope 200 are anchored to the upper flange of the beam 110, the load transferred from the deck plate can be effectively distributed and transferred to the upper flange 111 of the beam.

Thus, the wire rope 200 of the present invention can control deflection of the deck plate, distribute the load transferred from the deck plate, and transfer the load to the beam to distribute the load to be supported by the beam. As a result, it is possible to sufficiently secure the fire-proofing performance through an increase of stiffness of the beam.

Furthermore, since the wire rope 200 can be easily processed and handled and has a light weight, a large workforce is not required to install the wire rope and the wire rope has excellent workability and constructibility. In addition, since the wire rope has extremely high tensile strength, introduction of the pre-stress is easily carried out.

[Method for Anchoring the Wire Rope 200 of the Present Invention]

As described above, the object to which pre-stress is applied by means of the wire rope is a member which is moved integrally with the wire rope 200.

Consequently, this object is referred to as the composite slab between the beams. In other words, the pre-stress is introduced to the composite slab 100, which is formed by pouring the slab concrete 130 on the deck plate 120 by means of the wire rope 200.

Since the above pre-stress is introduced by the wire rope which is thinner than the slab, as compared with an installation of a conventional tendon (pre-stressed concrete tendon), it is possible to more effectively and economically introduce the pre-stress.

Methods for introducing the above pre-stress include a pre-tension method and a post-tension method, and these methods are described with reference to FIG. 4*a* and FIG. 4*b*.

Figure 4A:
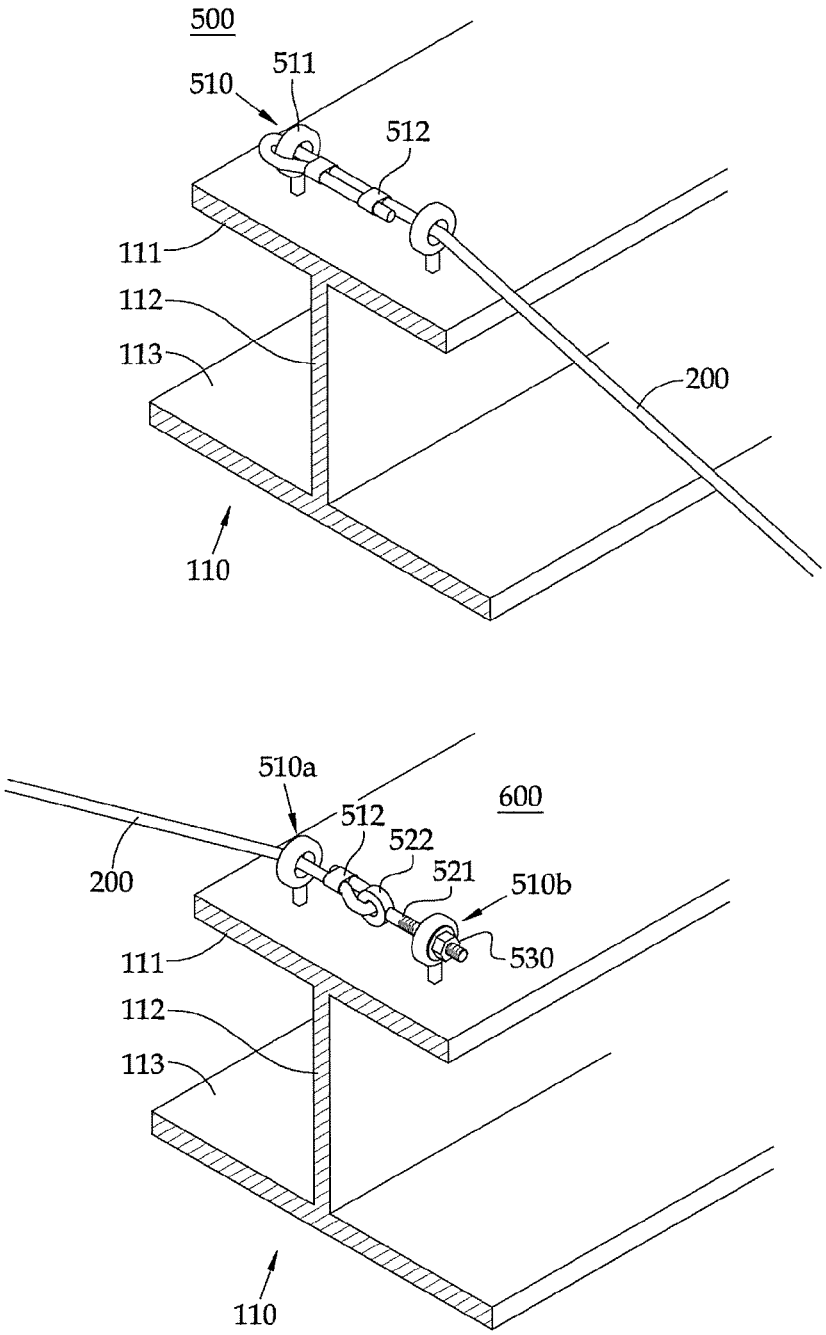
FIG. 4*a* and FIG. 4*b* are views showing processes for installing a wire rope by a pre-tensioning method and a post-tensioning method of the present invention.

First, introduction of the pre-stress according to FIG. 4*a* may be regarded as the pre-tension method.

In the pre-tension method, the wire rope 200 is disposed in the form of a quadratic curve by means of the above mentioned wire rope support 300 or the wire rope fixture 400, both end portions of the wire rope are first tensioned on an upper surface of the upper flange of the deck plate and are then anchored. Then, the slab concrete 130 is poured on the deck plate 120 and an upper portion of the beam 110 and the anchor is released.

For this purpose, a fixed anchor 500 is provided at an upper flange of one side beam, and a tensioned anchor 600 is installed at an upper flange of the other side beam.

First of all, the fixed anchor 500 is an anchor provided for fixing one end portion of the wire rope. For example, a ring-shaped bolt 510 having a circular ring part formed at an upper portion thereof is vertically installed on an upper surface of the upper flange of the beam 110, and one end portion of the wire rope 200 passes through the circular ring part 511 of the ring-shaped bolt 510 in the horizontal direction and is bent. Then, the circular ring part is compressed together with the overlapped wire rope by a compressing tool 512 (formed of a deformable material such as aluminum) so that it is possible to fix one end portion of the wire rope to the fixed anchor 500 in the shape of a closed loop.

At this time, it is preferable that one or two or more ring-shaped bolts 510 be spaced from each other and aligned with each other to set the wire lope on a straight line.

The anchor utilized for tensioning and anchoring the other end portion of the wire rope in a state in which one end portion of the wire rope is fixed to the fixed anchor is the tensioned anchor 600.

In this tensioned anchor 600, in order to set the other portion of the wire rope on one straight line, the ring-shaped bolt 510 having the circular ring part formed on an upper portion thereof is vertically installed on an upper surface of the upper flange of the beam.

At this time, two ring-shaped bolts 510 are installed and an anchoring bolt 520, which is horizontally installed, is inserted into an outer ring-shaped bolt 510*b*. Here, a bolt portion 521 of the anchoring bolt 520 is inserted into a circular ring part 522 of the outer ring-shaped bolt 510*b*, and the bolt portion 521 can be anchored to the outer ring-shaped bolt 510*b* by means of an anchoring nut 530.

The other end portion of the wire rope 200, which passes through an inner ring-shaped bolt 510*a* installed at the upper flange of the beam and extends, passes through the circular ring part 522 of the anchoring bolt 520 formed integrally with the bolt portion 521, and is bent. The circular ring part is then compressed together with the overlapped wire rope 200 by the compressing tool 512 (formed of a deformable material such as aluminum) so that it is possible to anchor the other end portion of the wire rope to an inner tensioned anchor 600 in the shape of a closed loop.

Thus, the wire rope is tensioned and anchored to the outer ring-shaped bolt 510*b* merely by rotating the anchoring nut 530 to introduce the pre-stress to the wire rope.

Accordingly, the slab concrete is poured on the deck plate and an upper portion of the beam to complete the composite slab, and once the anchoring nut is rotated in the opposite direction and loosened, the pre-stress is introduced to the composite slab.

Figure 4B:
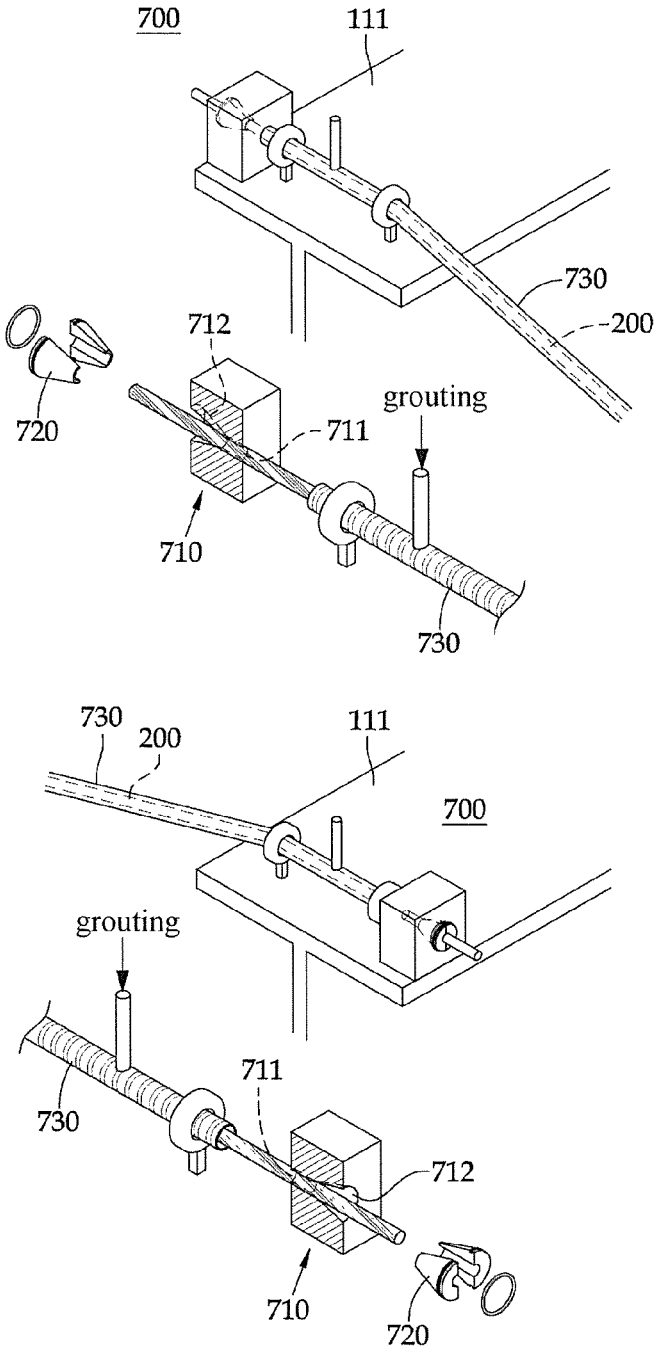

Next, an introduction of the pre-stress according to FIG. 4*b* may be regarded as the post-tension method. In the post-tension method, the wire rope 200 is disposed in the form of a quadratic curve, the slab concrete is poured on the deck plate and an upper portion of the beam, and both end portions of the wire rope are then tensioned on an upper surface of the upper flange of the deck plate and are then anchored.

If the wire rope is tensioned and anchored by means of the post-tension method, it is possible to introduce the pre-stress which can frequently control deflection of the slab. To achieve the above, one end portion of the wire rope 200 installed by the post-tension method is fixed through by the fixed anchor as shown in FIG. 4*a*, however, it can be seen from FIG. 4*b* that an anchoring block 710, a wedge 720 and a sheath 730 may be utilized for fixing the wire rope.

First of all, the tubular sheath 730 is disposed in the form of a quadratic curve, and the wire rope 200 may then pass through the sheath. If the sheath is not utilized, the coated wire rope such as an unbonded strand is employed. Ultimately, the sheath functions to prevent the wire rope 200 from being in direct contact with the slab concrete 130 or being embedded in the slab concrete.

Thus, after the wire rope 200 is installed first, one of both end portions of the wire rope is fix-anchored by means of the anchoring block 710 and the wedge 720, and the other one is tension-anchored.

First of all, the anchoring block 710 to which the fix-anchored end portion is installed will be described. The anchoring block has a through hole 711 formed therein, and the wire rope can pass through the through hole. An anchoring groove 712 in which an anchoring cone can be inserted is formed at a mid portion of the through hole 711, and the above anchoring block 710 is integrally fixed to an upper surface of the upper flange of the beam 110 by welding and the like.

Next, a plurality of heads of wedge segments are tied by a band so that when the wedge 720 is inserted in the anchoring groove 712, the wire rope 200 clamped to the wedge 720 is anchored to the anchoring groove.

Thus, due to the fix-anchoring, if one end portion of the wire rope clamped to the wedge 720 is inserted in the anchoring groove of the anchoring block and the other end portion of the wire rope is pulled, one end portion of the wire rope can ultimately be fix-anchored.

In comparison with the above, in the tension-anchoring method, in a state in which one end portion of the wire rope is fix-anchored as described above, the other end portion is tensioned by a hydraulic jacking device and the wedge 720 is inserted in the anchoring groove 712 formed on the anchoring block 710, if the tension state is released, the tensioned wire rope 200 is anchored in the anchoring groove 712 by a reaction force (in the direction which is opposite to the tension direction). In other words, the wire rope is tension-anchored.

The important point here is that even after an amount of time has lapsed, the other end portion of the wire rope 200, which is already tension-anchored, can be re-tensioned by the hydraulic jacking device so that the tension-anchoring method is very advantageous for controlling slab deflection of the composite slab.

At this time, if the sheath is utilized, the slab concrete is poured in the sheath through a pouring tube in the shape of a vertical tube and is then hardened. Once tensioning and anchoring of the wire rope are completed, grouting is performed to finish a completed sheath.

Of course, if the unbonded wire rope is employed, when the tensioning and the anchoring are performed, a cladding is peeled off to use the wire rope and the process is simpler in that there is no need to provide a pouring tube and perform a grouting step.

[Method for Fire-Proofing the Bare Long-Span Composite Slab by the Pre-Tension Method]

Figure 5A:
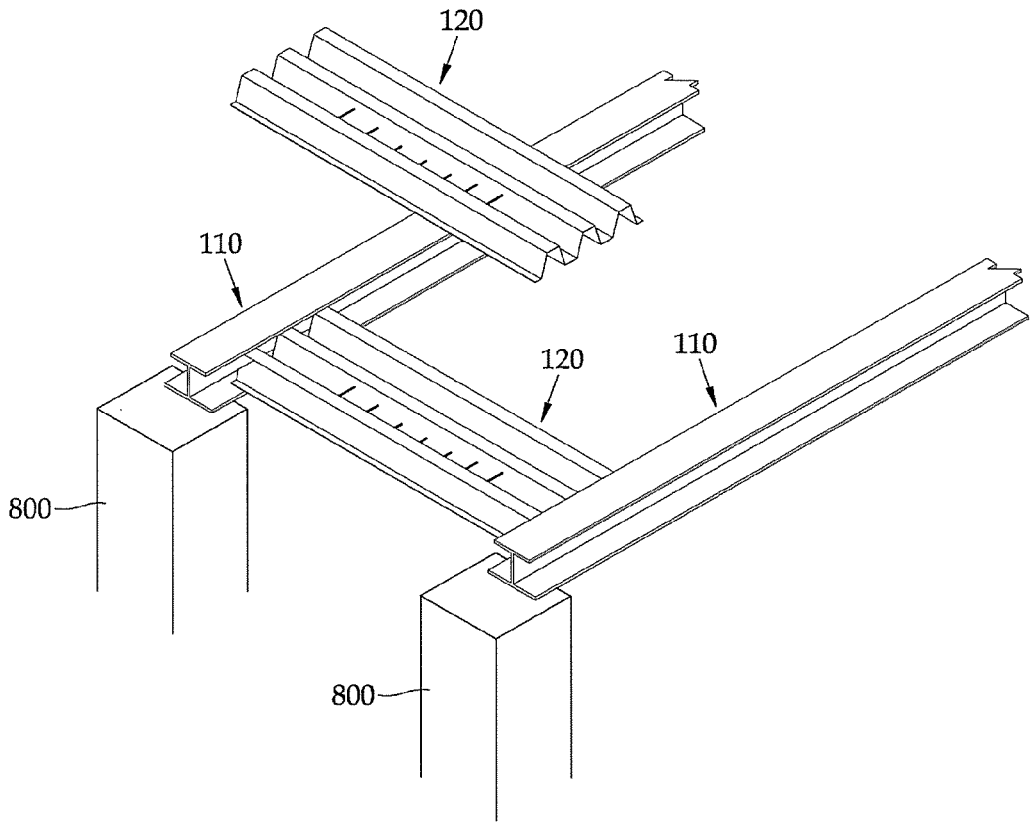
FIG. 5*a*, FIG. 5*b* and FIG. 5*c* are views showing a sequence of a method for fire-proofing a slab using a wire rope of the present invention (pre-tension method)
Figure 5B:
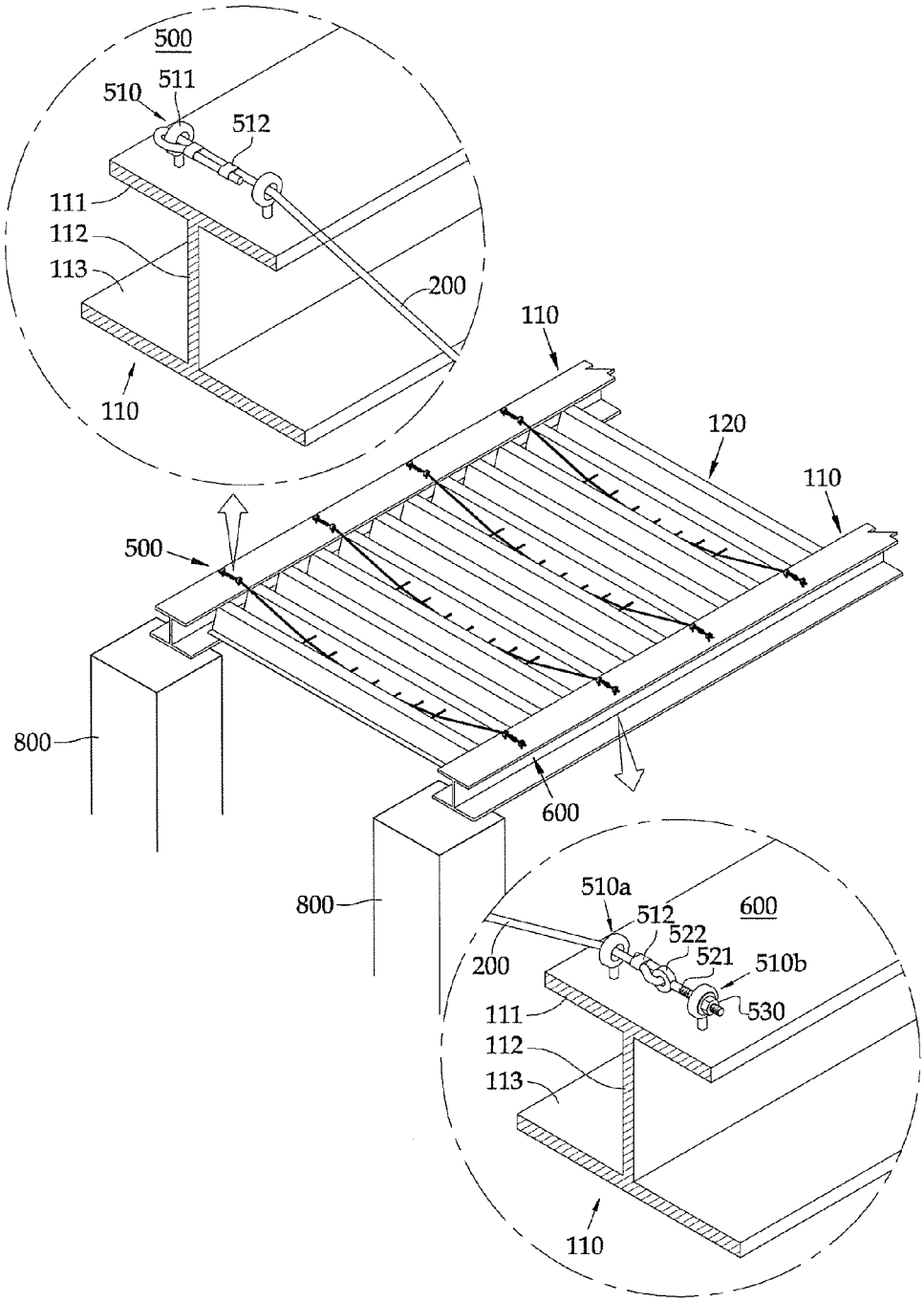
Figure 5C:
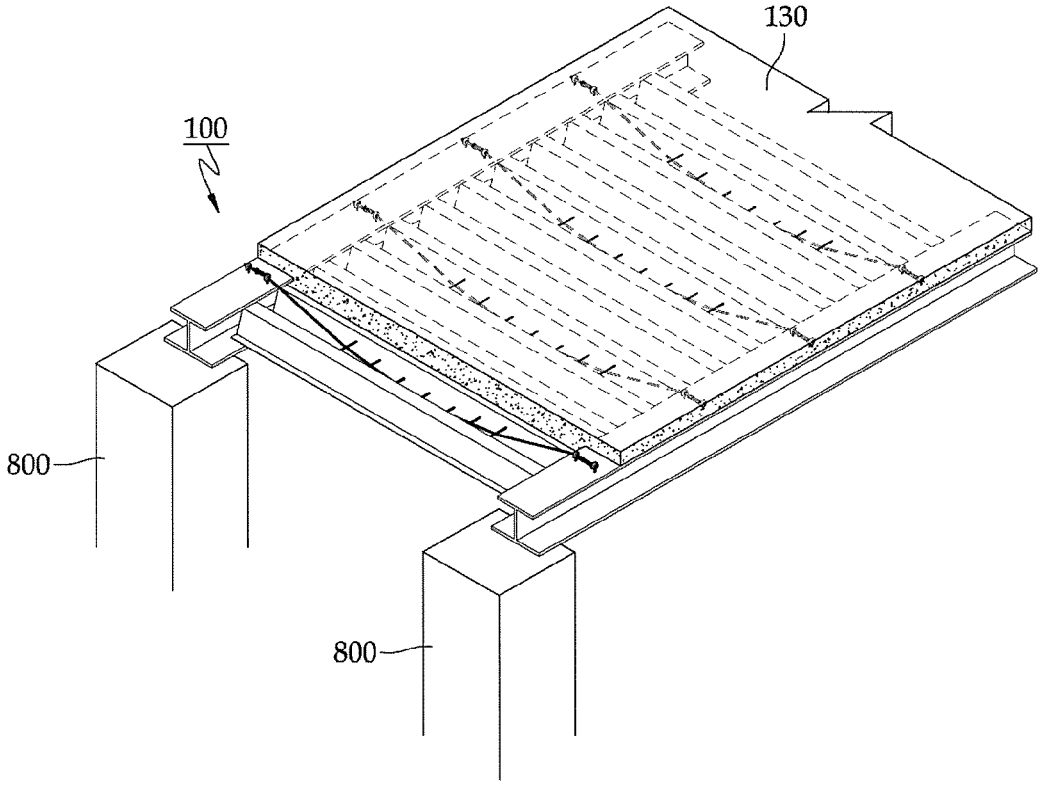

FIG. 5*a*, FIG. 5*b* and FIG. 5*c* are views showing a sequence of the method for fire-proofing the slab according to the pre-tension method.

As described above, the above fire-proofing method is performed according to the sequence consisting of installing the columns and the beams, installing the deck plate between the beams, installing the wire rope of the present invention on the deck plate, tensioning and anchoring the wire rope on the upper flange of the beam, arranging the slab reinforcing bar on the beam and the deck, and pouring the slab concrete to embed the slab reinforcing bar and the wire rope in the slab concrete.

Referring to FIG. 5*a*, columns 800 are constructed and the beam 110 is installed between the columns. The above beam 110 may be constructed as the steel beam structure formed of a steel material.

In the beam 110, furthermore, the tendons (pre-stressing strands) are arranged at both sides of the web plate to introduce the pre-stress in the longitudinal direction so that it is possible to secure a fire-proofing performance for increasing a stiffness of the beam.

In other words as shown in FIG. 5*b*, the deck plate 120 acting as a form for the slab concrete is installed between the above beams, the structure in which the horizontal part and the bending part are continuously formed as shown in FIG. 1 is employed as the above deck plate 120 and this deck plate has a large vertical length (sectional height H) so that it is advantageous for a long-span composite slab.

This deck plate 120 is installed such that an end portion of the deck plate is supported between the lower flanges of the beams 110, and the wire rope 200 of the present invention is installed to enable the load transferred from the deck plate to be distributed and transferred.

To achieve the above, the wire rope support 300 is provided on the deck plate 120 as shown in FIG. 3*a*. Thus, the wire rope 200 is disposed such that the wire rope is placed below the wire rope support 300 and both end portions thereof extend to upper surfaces of the upper flanges of both side beams.

As described above, at this time, it can be seen that the ring-shaped bolt 510 is formed on the upper flange of the beam for enabling the wire rope to be tensioned and anchored through the pre-tension method.

Therefore, one end portion of the wire rope 200 is fix-anchored to the ring-shaped bolt 510 and the other end portion is tension-anchored to the ring-shaped bolt.

Next, as shown in FIG. 5*c*, once the slab concrete 130 is poured on the beam and the upper portion of the deck plate and then hardened, the anchoring nut in the tensioned anchor of the wire rope is loosened to introduce the pre-stress to the Composite Slab.

[Method for Fire-Proofing the Bare Long-Span Composite Slab by the Post-Tension Method]

Figure 6A:
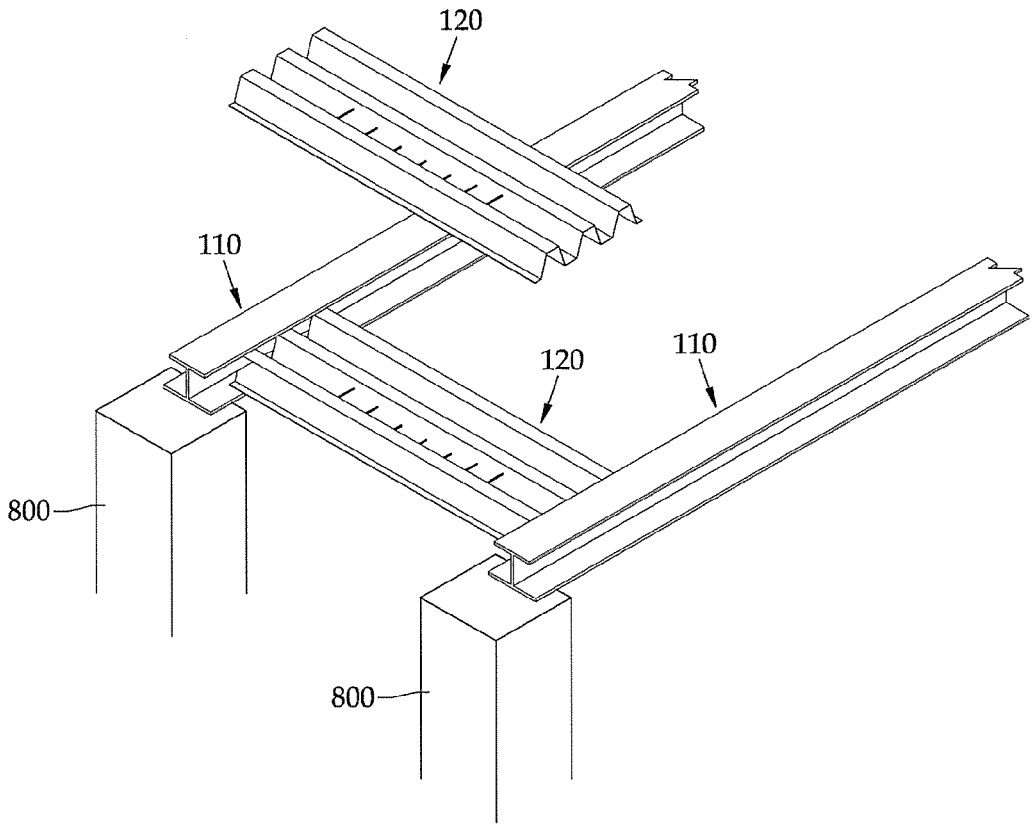
FIG. 6*a*, FIG. 6*b* and FIG. 6*c* are views showing a sequence of a method for fire-proofing a slab using a wire rope of the present invention (post-tension method).
Figure 6B:
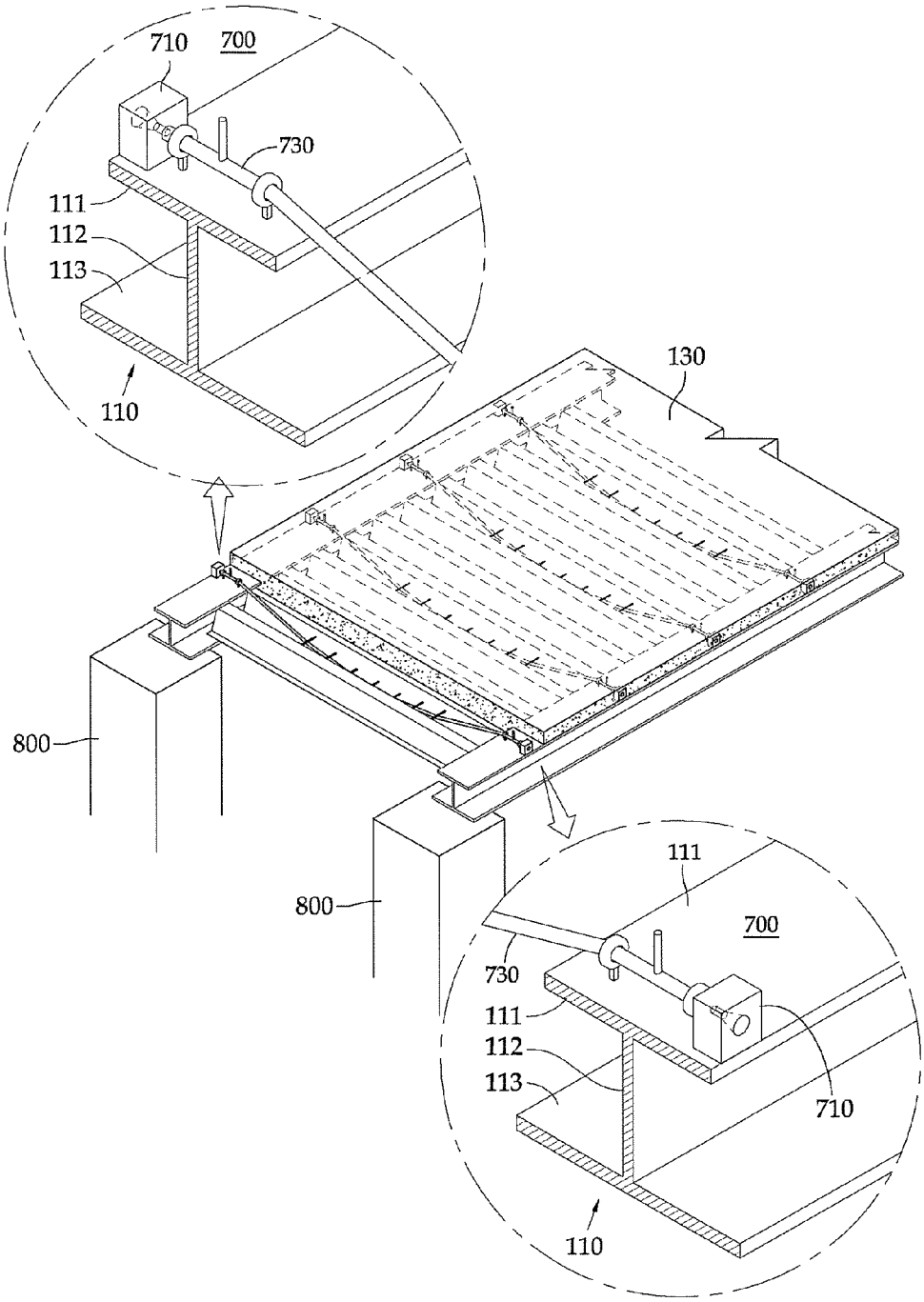
Figure 6C:
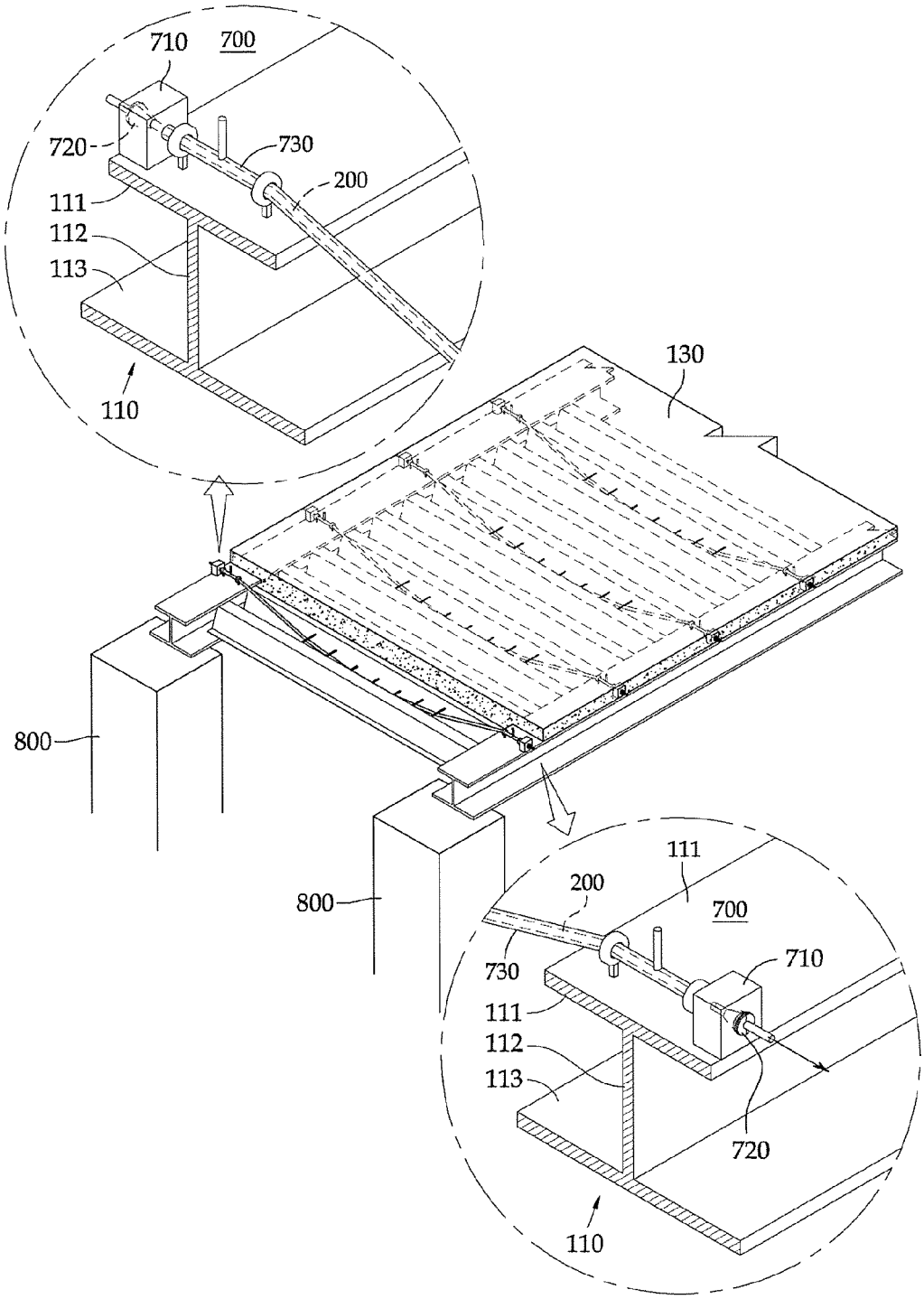

FIG. 6*a*, FIG. 6*b* and FIG. 6*c* are views showing a sequence of the method for fire-proofing the bare long-span composite slab according to the post-tension method.

Unlike the pre-tension method, instead of the ring-shaped bolt 510, the anchoring block is installed on the beam, and the wire rope is tensioned and anchored after the concrete is poured and hardened.

In other words, as shown in FIG. 6*a*, the above fire-proofing method is performed according to the sequence consisting of installing the columns and the beams, installing the deck plate between the beams, installing the sheath in which the wire rope of the present invention can be inserted on the deck plate, inserting the wire rope in the sheath, arranging the slab reinforcing bar on the beam and the deck, and pouring the slab concrete to embed the slab reinforcing bar and the wire rope in the slab concrete.

Of course, if the sheath is not utilized and the unbonded wire rope is installed, the above fire-proofing method is performed according to the sequence consisting of installing the unbonded wire rope without installing the sheath, arranging the slab reinforcing bar on the beam and the deck plate, and pouring the slab concrete to embed the slab reinforcing bar and the wire rope in the slab concrete.

The method utilizing the sheath is described in the present invention.

Referring to FIG. 6*a*, like the above, the columns 800 are constructed and the beam 110 is installed between the columns. The above beam 110 may be constructed as the steel beam structure formed of a steel material.

In the beam 110, furthermore, the tendons (pre-stressing strands) are arranged at both sides of the web plate to enable the pre-stress to be introduced in the longitudinal direction.

Like the above, the deck plate 120 acting as a form for the slab concrete is installed between the above beams.

An end portion of the deck plate 120 is also installed and supported between the lower flanges of the beams 110. However, the wire rope 200 of the present invention is installed to enable the load transferred from the deck plate to be distributed and transferred.

To achieve the above, the wire rope support 300 is provided at the deck plate 120. Thus, the wire rope 200 is arranged under the wire rope support 300, and both end portions of the wire rope extend to upper surfaces of the upper flanges of both side beams.

At this time, it can be seen that the anchoring blocks 710 are installed on the upper flange of the beam and spaced apart from each other.

Next, as shown in FIG. 6*b*, the slab concrete 130 is poured on the beam and the deck plate and then hardened.

Subsequently, as shown in FIG. 6*c*, one end portion of the wire rope 200 is fix-anchored to one side anchoring block by means of the wedge 720, and the other end portion is tension-anchored to the ring shaped bolt 510 of the other side anchoring block through the wedge to introduce the pre-stress to the composite slab.

In the post-tension method or the pre-tension method, due to the above, the present invention can control deflection at the mid portion of the long-span composite slab at which the largest deflection is generated through the wire rope to enhance the fire-proofing performance of the composite slab.

In addition, through the above control of the deflection, the wire rope is fixed to the mid portion of the deck plate, and both end portions are fixed and anchored to the upper flange of the beam to enable the transferred load to be distributed to the upper flange of the beam so that it is possible to secure more effective fire-proofing performance.

Furthermore, by the tension and the anchor, the pre-stress is introduced to the wire rope, and the wire rope is disposed in the form of a quadratic curve to enable the pre-stress introduction effect to be enhanced by an eccentric effect.

Also, since the wire rope is employed, the worker can easily convey, machine and install the wire rope so that more excellent constructibility and workability can be obtained. As a result, it is possible to sufficiently secure economic efficiency through the shortening of the construction time.

The present invention has the following advantages.

First, by means of the control of deflection of the long-span slab through the wire rope, it is possible to secure more excellent fire-proofing performance of the deck plate. Due to the above, it is possible to provide the method for fire-proofing the long-span slab which does not require a conventional spray-applied material and a process for installing a refractory material for the deck plate.

Second, the load transferred from the deck plate through the wire rope can be distributed and transferred to the beam. Consequently, it is possible to provide the method for fire-proofing the long-span slab which can promote the longer-span of the slab.

Third, the pre-stress introduced to the wire rope can provide the method for fire-proofing the long-span slab which simplifies a process for controlling deflection of the deck plate and can provide excellent workability to secure constructibility and economic efficiency.

Fourth, the present invention can provide the method for fire-proofing the long-span slab which employs the pre-tension method or the post-tension method for introducing the pre-stress to the wire rope. Here, the post-tension method can be utilized as a means for maintenance in the future.

It will be apparent to those skilled in the art that various modifications can be made to the above-described exemplary embodiments of the present invention without departing from the spirit or scope of the invention. Thus, it is intended that the present invention covers all such modifications provided they come within the scope of the appended claims and their equivalents.

What is claimed is:

1. A method for fire-proofing a composite slab using a wire rope, comprising;

installing a deck plate (120) between beams (110);

anchoring a wire rope (200) to allow the wire rope to be connected to a mid portion of the installed deck plate (120) and both end portions of the wire rope to extend to upper flanges (111) of the beams (110), and part of the upper flange is located above the deck plate; and forming slab concrete (130) on the beam and the deck plates, wherein one end portion of the wire rope (200) is fix-anchored to one of the beams and the other end portion of the wire rope is tension-anchored to another one of the beams to allow pre-stress to be introduced to the slab concrete (130 through a post-tension method or a pre-tension method such that the load transferred from the deck plate is distributed and transferred to the beam via the wire rope to enhance fire-proofing performance.

2. The method for fire-proofing the composite slab using the wire rope of claim 1, wherein an end portion of the deck plate (120) is supportably installed on a lower flange of one of the beams.

3. The method for fire-proofing the composite slab using the wire rope of claim 1, wherein the mid portion of the deck plate is a region corresponding to L/2 of the extension length L of the deck plate, the deck plate (120) is a bending panel in which bending portions are formed between horizontal portions, a plurality of wire rope supports (300) are spaced from each other and arranged between the bending portions at the mid portion of the deck plate in the form of a parabola curved downward in the longitudinal direction of the deck plate, and the wire rope is disposed such that an upper surface of the wire rope is in contact with a lower surface of the wire rope support deck, whereby the wire rope is disposed in the form of a parabola.

4. The method for fire-proofing the composite slab using the wire rope of claim 1, wherein the mid portion of the deck plate is a region corresponding to L/2 of the extension length L of the deck plate, the deck plate (120) is a bending panel in which a bending portion is formed between horizontal portions, wire rope fixtures (400) spaced apart from each other and having heights which differ from each other are disposed on an upper surface of the horizontal portion at the mid portion of the deck plate in the shape of a parabola in the longitudinal direction of the deck plate, and the wire rope passes through the wire rope fixtures, whereby the wire rope is disposed in the shape of a parabola.

5. The method for fire-proofing the composite slab using the wire rope of claim 1, wherein the mid portion of the deck plate is a region corresponding to L/2 of the extension length L of the deck plate, the deck plate (120) is a bending panel in which a bending portion is formed between horizontal portions, wire rope fixtures (400) spaced apart from each other are disposed on a side surface of the horizontal portion at the mid portion of the deck plate in the shape of a parabola curved downward in the longitudinal direction of the deck plate, and the wire rope passes through the wire rope fixtures, whereby the wire rope is disposed in the shape of a parabola.

6. The method for fire-proofing the composite slab using the wire rope of claim 1, wherein the fix-anchoring of the wire rope (200) is performed using a fixed anchor (500) and comprises, vertically installing a ring-shaped bolt (510) having a circular ring part formed on an upper portion thereof on an upper surface of the upper flange of the one of the beams (110), and passing one end portion of the wire rope (200) in the horizontal direction through the circular ring part (511) of the ring-shaped bolt (510), bending one end portion of the wire rope, and compressing the circular ring part together with an overlapped portion of the wire rope by a compressing tool (512), wherein one end portion of the wire rope is fix-anchored to the upper flange of the one of the beams by the fixed anchor (500).

7. The method for fire-proofing the composite slab using the wire rope of claim 1, wherein the fix-anchoring of the wire rope (200) is performed using an anchoring block (710) and a wedge (720), and comprises integrally fixing the anchoring block (710) to an upper surface of the upper flange of the one of the beams (110), the anchoring block having a through hole (711) through which the wire rope (200) passes formed therein and an anchoring groove (712) formed at a mid portion of the through hole (711) in which an anchoring cone is inserted, and inserting the wedge to allow the wire rope (200) clamped to the wedge (720) to be anchored to the anchoring groove, wherein one end portion of the wire rope is fix-anchored to the anchoring block (710) formed on the upper flange of the one of the beams.

8. The method for fire-proofing the composite slab using the wire rope of claim 1, wherein the tension-anchoring of the wire rope (200) is performed using a tensioned anchor (600), and comprises installing two ring-shaped bolts (510) on an upper surface of the another one of the beams, and inserting an anchoring bolt (520) to be horizontally anchored into an outer ring-shaped bolt (510*b*) to allow a bolt portion (521) of the anchoring bolt (520) to be inserted into a circular ring part (522) of the outer ring-shaped bolt (510*b*), passing the other end portion of the wire rope (200), which passes through an inner ring-shaped bolt (510*a*) installed at the upper flange of the another one of the beams and extends, through the circular ring part (522) of the anchoring bolt (520) formed integrally with the bolt portion (521) and bending it, and compressing the circular ring part together with an overlapped portion of the wire rope (200) by a compressing tool (512) to anchor the other end portion of the wire rope to an inner tensioned anchor (600), wherein the bolt portion (521) is anchored to the outer ring-shaped bolt (510*b*) by an anchoring nut (530).

9. The method for fire-proofing the composite slab using the wire rope of claim 1, wherein the tension-anchoring of the wire rope (200) is performed using an anchoring block (710) and a wedge (720), and comprises integrally fixing the anchoring block (710) to an upper surface of the upper flange of the another one of the beams (110), the anchoring block having a through hole (711) through which the wire rope (200) passes formed therein and an anchoring groove (712) formed at a mid portion of the through hole (711) in which an anchoring cone is inserted, tensioning the wire rope, inserting the wedge to allow the wire rope (200) clamped to the wedge (720) to be anchored to the anchoring groove, wherein the other end portion of the wire rope is fix-anchored to the anchoring block (710) formed on the upper flange of the another one of the beams.

* * * * *